US010876763B2

(12) United States Patent
Han et al.

(10) Patent No.: US 10,876,763 B2
(45) Date of Patent: Dec. 29, 2020

(54) MULTIFUNCTION HOT AIR HEATING GUN

(71) Applicant: Zhejiang Prulde Electric Appliance Co., Ltd., Jinhua (CN)

(72) Inventors: Ting Han, Jinhua (CN); Weiming Yang, Jinhua (CN)

(73) Assignee: Zhejiang Prulde Electric Appliance Co., Ltd., Zhejiang (CN)

( * ) Notice: Subject to any disclaimer, the term of this patent is extended or adjusted under 35 U.S.C. 154(b) by 279 days.

(21) Appl. No.: 14/994,759

(22) Filed: Jan. 13, 2016

(65) Prior Publication Data

US 2016/0201945 A1 Jul. 14, 2016

(30) Foreign Application Priority Data

Jan. 14, 2015 (CN) ..... 2015 2 0023797 U

(51) Int. Cl.
*F24H 3/04* (2006.01)

(52) U.S. Cl.
CPC ..... *F24H 3/0423* (2013.01)

(58) Field of Classification Search
CPC ..... F24H 3/0423; F24H 3/00; A45D 20/10; A45D 20/122
USPC ..... 392/383, 384, 385, 471; 417/234
See application file for complete search history.

(56) References Cited

U.S. PATENT DOCUMENTS 597,469 A * 1/1898 Marshall ..... A61C 1/18 433/124
1,821,525 A * 9/1931 Emanuel ..... A45D 20/12 392/385
2,031,391 A * 2/1936 Spielman ..... F24H 3/0423 392/384
2,096,023 A * 10/1937 Albertson ..... F24H 3/0405 392/383
2,542,038 A * 2/1951 Lewis ..... B21J 15/18 173/206
2,597,215 A * 5/1952 Wright ..... A45D 20/44 392/488
2,834,866 A * 5/1958 Bentzman ..... A45D 20/08 392/385
3,086,698 A * 4/1963 Goldstein ..... F04D 25/084 417/411
3,094,606 A * 6/1963 Ferris ..... B44D 3/168 219/228
3,109,083 A * 10/1963 Meltzer ..... B44D 3/168 219/228

(Continued)

*Primary Examiner* — Jimmy Chou
(74) *Attorney, Agent, or Firm* — JCIP Global Inc.

(57) ABSTRACT

A multifunction hot air heating gun, comprises a handle, a gun head assembly, a switching button and an on-and-off button; a first junction surface disposed with a rotating connect hole is located on the handle; the gun head assembly comprises a second junction surface matching with the first junction surface, and the second surface is disposed with a rotating joint; the gun head assembly comprises a first position and a second position and may pivot between the first position and the second position; the switching button is disposed on the handle assembly or the head gun assembly and comprises a locking position and a unlocking position; The locking position is used for limit the relative rotate of the handle assembly and the head gun assembly, and the unlocking position is used to release the limit; the on-and-off button is disposed on the handle assembly to control the operation of the head gun assembly.

10 Claims, 7 Drawing Sheets

(56) References Cited

U.S. PATENT DOCUMENTS 3,115,567 A * 12/1963 Meltzer ..... B44D 3/168 392/384
3,209,988 A * 10/1965 Fox ..... F24H 3/0423 417/423.1
3,211,890 A * 10/1965 Graves ..... B64D 15/12 392/385
3,332,284 A * 7/1967 Meltzer ..... G01K 13/02 374/148
3,492,462 A * 1/1970 Schumacher ..... A45D 20/10 392/385
3,599,345 A * 8/1971 Tolmie ..... A45D 20/10 34/97
3,610,881 A * 10/1971 Stewart ..... F24H 3/0423 392/384
3,612,824 A * 10/1971 Berryman ..... F24H 3/0423 392/383
3,668,370 A * 6/1972 Pattison ..... F24H 3/0423 392/385
3,846,047 A * 11/1974 Wada ..... A45D 20/10 417/234
3,943,329 A * 3/1976 Hlavac ..... A45D 20/122 392/379
3,986,272 A * 10/1976 Feierabent ..... A45D 20/12 34/97
4,039,774 A * 8/1977 Kata ..... A45D 20/10 392/384
4,135,080 A * 1/1979 Wells, Jr. ..... A45D 20/08 34/201
4,198,558 A * 4/1980 Benty ..... A45D 20/12 132/212
4,404,706 A * 9/1983 Loyd ..... A47L 5/14 15/344
4,413,371 A * 11/1983 Tuggle ..... E01H 1/0809 15/328
D274,551 S * 7/1984 Benjamin ..... D28/13
D279,814 S * 7/1985 Gaines ..... D8/29.1
4,551,615 A * 11/1985 Wilson ..... B44D 3/168 219/222
D283,259 S * 4/1986 Stansbury, Jr. ..... D28/13
4,629,864 A * 12/1986 Wilson ..... F24H 3/0423 34/99
D288,472 S * 2/1987 Miller ..... D23/332
D288,841 S * 3/1987 Steinel ..... D23/332
4,683,370 A * 7/1987 Petersen ..... F24H 3/0423 34/667
D293,020 S * 12/1987 Steinel ..... D23/332
4,734,017 A * 3/1988 Levin ..... A47L 5/24 417/366
D296,070 S * 6/1988 Cunningham ..... D28/13
4,759,240 A * 7/1988 Lin ..... B25F 5/02 403/160
D297,397 S * 8/1988 Pagani ..... D8/29.1
D297,398 S * 8/1988 Pagani ..... D8/29.1
4,826,049 A * 5/1989 Speer ..... B05C 17/00523 200/51.09
4,849,607 A * 7/1989 Meo ..... B25B 33/00 392/385
4,904,847 A * 2/1990 Kosaka ..... A45D 20/12 392/384
D310,733 S * 9/1990 Gelinas ..... D28/13
5,023,925 A * 6/1991 Goll ..... F24H 3/0423 392/384
D322,742 S * 12/1991 Spratt ..... D28/13
5,074,006 A * 12/1991 Eremita ..... A01K 13/002 15/344
5,091,630 A * 2/1992 Djuric ..... A45D 20/12 132/112
D334,876 S * 4/1993 Swetish ..... D8/29.1
5,349,161 A * 9/1994 Bockholt ..... G05D 23/1913 219/240
5,372,420 A * 12/1994 Van Deursen ..... B01F 13/002 173/170
5,606,640 A * 2/1997 Murphy ..... A47K 10/06 219/521
5,636,815 A * 6/1997 Wilson ..... A45D 20/12 248/125.3
5,671,321 A * 9/1997 Bagnuolo ..... A45D 20/122 34/96
5,722,111 A * 3/1998 Sowell ..... A01G 20/47 15/330
5,749,704 A * 5/1998 Jerdee ..... F04D 17/165 310/58
5,768,749 A * 6/1998 Ohi ..... A47L 5/14 15/328
5,841,943 A * 11/1998 Nosenchuck ..... A45D 20/10 392/385
5,884,008 A * 3/1999 Goldberg ..... A45D 20/12 206/320
5,894,630 A * 4/1999 Bitner ..... A01G 20/47 15/330
6,026,590 A * 2/2000 Picozza ..... A45D 20/16 34/90
6,068,543 A * 5/2000 Renn ..... B23D 59/007 29/26 A
6,105,206 A * 8/2000 Tokumaru ..... A47L 5/14 15/344
6,370,326 B2 * 4/2002 Cheng ..... F24H 3/0423 392/384
D456,679 S * 5/2002 Cheng ..... D8/29.1
D457,044 S * 5/2002 Cheng ..... D8/29.1
D458,524 S * 6/2002 Cheng ..... D8/29.1
6,460,272 B2 * 10/2002 Cheng ..... F26B 21/001 34/96
6,738,564 B1 * 5/2004 Tung ..... F24H 3/0423 239/288.5
6,834,413 B2 * 12/2004 Sanders ..... A47L 5/14 15/405
6,889,445 B1 * 5/2005 Varona ..... A45D 20/12 34/97
D516,883 S * 3/2006 Popov ..... D8/29.1
7,010,866 B1 * 3/2006 Lin ..... A45D 20/30 34/96
D552,443 S * 10/2007 Aglassinger ..... D8/29.1
D572,097 S * 7/2008 Yung-Kuan ..... D28/13
D615,834 S * 5/2010 Netzler ..... D8/29.1
D615,835 S * 5/2010 Netzler ..... D8/29.1
7,739,773 B2 * 6/2010 Schliemann ..... E01H 1/0809 15/344
D639,129 S * 6/2011 Van Wambeke ..... D8/29.1
7,982,163 B2 * 7/2011 Chung ..... F24H 3/0423 219/227
D679,561 S * 4/2013 Price ..... D8/29.1
8,434,238 B2 * 5/2013 Gross ..... A45D 20/12 132/212
8,555,999 B2 * 10/2013 McRoberts ..... B25F 5/02 173/170
8,707,577 B2 * 4/2014 Lee ..... A45D 20/12 132/212
8,712,226 B2 * 4/2014 Lee ..... A47G 27/0437 156/497
D710,165 S * 8/2014 Radwill ..... D8/29.1
8,936,434 B2 * 1/2015 Peterson ..... F04D 25/084 415/218.1
8,942,550 B1 * 1/2015 Carter ..... F24H 3/0423 248/168
8,948,577 B2 * 2/2015 Eberli ..... F24H 3/0423 392/379
D740,629 S * 10/2015 Furling ..... D8/29.1
D742,708 S * 11/2015 Howell ..... D8/29.1
9,266,230 B2 * 2/2016 Maddilate ..... B25F 5/02
9,510,395 B2 * 11/2016 Coulton ..... A45D 20/38
9,746,202 B2 * 8/2017 Takemoto ..... F24H 3/0423
9,795,200 B2 * 10/2017 Annunziata ..... A45D 20/12
D803,649 S * 11/2017 van der Rest ..... D8/68
10,046,894 B1 * 8/2018 Carter ..... B65D 69/00
2003/0235462 A1 * 12/2003 Cheng ..... F24H 9/06 403/329
2008/0121074 A1 * 5/2008 Hu ..... B25G 1/066 81/177.8

(56) References Cited

U.S. PATENT DOCUMENTS

| | | | | |
|---|---|---|---|---|
| 2008/0181590 | A1* | 7/2008 | Radwill | F24H 3/0423 392/385 |
| 2009/0271945 | A1* | 11/2009 | Ludwigson | F04D 25/084 15/415.1 |
| 2010/0008655 | A1* | 1/2010 | Tackitt | F24H 3/0423 392/385 |
| 2010/0065545 | A1* | 3/2010 | Chung | F24H 3/0423 219/227 |
| 2010/0212095 | A1* | 8/2010 | Suen | B44D 3/164 15/105 |
| 2011/0203821 | A1* | 8/2011 | Puzio | B25B 23/0064 173/1 |
| 2012/0048071 | A1* | 3/2012 | Huang | B25G 1/066 81/177.8 |
| 2012/0124854 | A1* | 5/2012 | Lee | A45D 20/12 34/97 |
| 2012/0160529 | A1* | 6/2012 | Eshleman | B25B 21/00 173/1 |
| 2013/0008043 | A1* | 1/2013 | Correll, Jr. | A45D 20/12 34/97 |
| 2014/0219643 | A1* | 8/2014 | Ma | F24H 3/0423 392/384 |
| 2015/0192324 | A1* | 7/2015 | Takemoto | F24H 3/0423 392/385 |
| 2015/0192325 | A1* | 7/2015 | Takemoto | F24H 3/0423 392/385 |
| 2015/0354812 | A1* | 12/2015 | Yang | F23D 14/28 431/344 |
| 2016/0201945 | A1* | 7/2016 | Han | F24H 3/0423 392/385 |
| 2017/0074510 | A1* | 3/2017 | Yang | F23D 14/52 |
| 2017/0241423 | A1* | 8/2017 | Han | A47L 9/2842 |

* cited by examiner

MULTIFUNCTION HOT AIR HEATING GUN

TECHNICAL FIELD

The present utility model relates to a multifunction hot air heating gun.

BACKGROUND TECHNICAL

Hot air heating guns are usually used for baking or drying, and they are used for melting plastic products so as to take welding process, while they could be used as charcoal burning machines or weeding machines in every life. Different functions or circumstances require different operation modes (handheld modes), however, most of hot air heating guns in the prior arts are designed for the applications in industry, that is, the applications of melting plastic product to take welding process, while targeted designs the applications are never be seen in charcoal burning and weeding and make the users inconvenient.

CONTENTS OF THE INVENTION

The technical problem that the utility model aims to solve is to overcome the shortages of the prior art by providing a multifunction hot air heating gun, which has functions of providing general hot air, charcoal burning and weeding, and may be quickly switched between various functions according to specific operational requirements to facilitate use.

The following technical solution is used in the present utility model in order to solve the above-mentioned problems.

A multifunction hot air hot air heating gun, comprises:

A handle assembly, which comprises a handle and an extension rod connected to the handle, and a first junction surface disposed with a rotating connect hole is located on the handle;

A gun head assembly that is used for ejecting hot air, which comprises a second junction surface matching with the first junction surface, and the second surface is disposed with a rotating joint. The rotating joint and the rotating connect hole are connected together so as to make the handle and the gun head assembly be connected together and be able to rotate relative to each other. The gun head assembly comprises a first position and a second position. The first position is used to eject hot air toward the extended direction of the handle axis, while the second position is used to eject hot air toward the lateral direction. The gun assembly may pivot between the first position and the second position;

A switching button, which is disposed on the handle assembly or the head gun assembly and comprises a locking position and an unlocking position. The locking position is used for limit the relative rotate of the handle assembly and the head gun assembly, and the unlocking position is used to release the limit;

An on-and-off button, which is disposed on the handle assembly to control the operation of the head gun assembly.

The handle assembly of the multifunction hot air heating gun in the present utility model comprises a handle and an extension rod connected to the handle, and comprises a head gun that may rotate relative to the handle, and the head gun assembly comprise a first position that is used to eject hot air toward the extended direction of the handle axis and a second position is used to eject hot air toward the lateral direction, and the head gun may pivot between the first and second positions. With the above-mentioned structures, the users may operate under different circumstances: the hot air heating gun may be used as charcoal burning machines when the gun head moves to the first position, and the hot air heating gun may be used as weeding machines with the extension rod setting, and when the gun head pivots to the second position, the hot air heating gun may be used for general hot air operation, for example, for melting the plastic product to carry on welding process.

With setting a switching button on the present multifunction hot air heating gun, the function switching operation of the gun head assembly becomes more convenient, and the reliability of the using process is improved.

In the first embodiment of the present utility model, the rotating joint rotates 180° relative to the rotating connector hole so as to turn gun head assembly from the first position to the second position, or from the second position to the first position. Therefore, the structure is designed to ensure that the hot air heating gun adapts the function design requirement to improve the using effect.

In the second embodiment of the present utility model, the handle comprises a gripping part and a connecting part that is disposed in the front end of the gripping part. The first junction surface is located on the connecting part and is disposed in an inclined way relative to the handle axis. The second junction surface contacts the first junction surface and rotates relative to the first junction surface.

In the third embodiment of the present utility model, the on-and-off button is disposed on the connecting part at the side with its back to the gun head assembly. The on-and-off button may be closer to the gripping part of the handle, and the user may operate the gun with a single hand, that is, the user may contact the on-and-off button while gripping the handle to improve the convenience.

In the fourth embodiment of the present utility model, the drive direction of the on-and-off button and the handle axis form a $\alpha$ angle, and $0°<\alpha<90°$. Therefore, the structure is convenient for the user when the hot air heating gun is used as a weeding machine.

In the fifth embodiment of the present utility model, a first positioning slot and a second positioning slot are disposed with intervals in the circumference direction of the rotating joint, and the switching button is disposed with a positioning block. When the gun head assembly pivots to the first position, the positioning block is plugged into the first positioning slot to keep the gun head assembly in the first position, and when the gun head assembly pivots to the second position, the positioning block is plugged into the second slot to keep the gun head assembly in the second position. Therefore, the positioning structure is simply and is easy to design.

In the sixth embodiment of the present utility model, the rotating joint is disposed with a limit piece projecting radially on the periphery. Two sides of the limit piece in the circumference direction is first limit end and a second limit end respectively, and the a first limit block and a second limit block are disposed with intervals in the inner side of the rotating connecting hole along the circumference direction. When the gun head assembly pivots to the first position, the first limit end contacts with the first limit block to prevent the gun head assembly from going on to rotate, and when the gun head assembly pivots to the second position, the second limit end contacts with the second limit block to prevent the gun head assembly from going on to rotate. Therefore, the gun head assembly can only move back and forth between the first position and the second position, and the reliability is ensured.

In the seventh embodiment of the present utility model, the handle and the extension rod form a detachable connection to enhance the convenience.

In the eighth embodiment of the present utility model, the handle is disposed with a speed shift switch and a rotating disk. The speed shift switch is fitted in the handle, and the rotating disk is rotationally connected onto the handle. The rotating disk is turned to drive the speed shift switch to regulate the intensity of the hot air.

In the ninth embodiment of the present utility model, the gun head assembly is disposed with a support frame, which comprises a support position and a folded position, and the support frame may move between the support position and the folded position. Through this design, the ease of use is improved especially when the hot air heating gun is used as charcoal burning machines.

The characteristics and the advantages will be described in details in the following specific embodiments and figures.

DESCRIPTION OF THE FIGURES

The present utility model will be further explained with reference of figures in the following description.

SPECIFIC EMBODIMENT

The technical solutions may be explained with referring to the figures in the following descriptions, but the following embodiments should be considered as preferred embodiments rather than all of the embodiments. Base on the following embodiments, the embodiments that persons having ordinary skill in the art may obtain without creative work belong to the protection range of the utility model.

Figure 1:
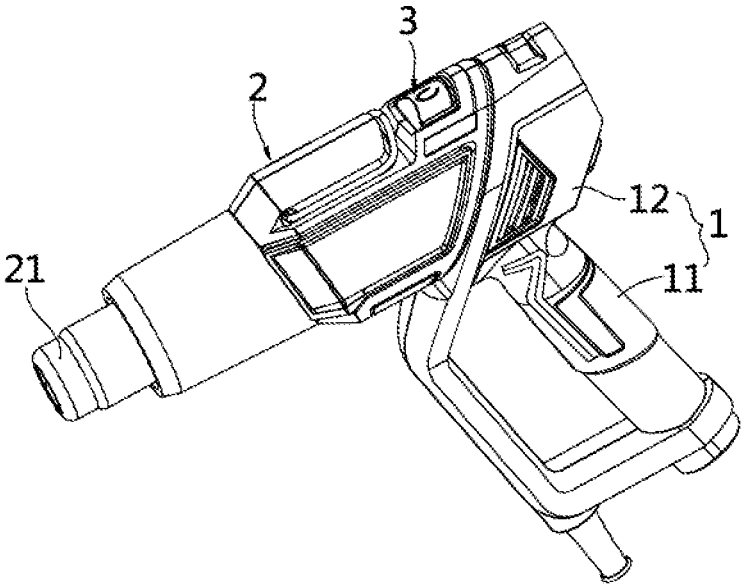
FIG. 1 is a schematic diagram of the external structure of the hot air heating gun in the preferred embodiment of the present utility model (conventional hot air operation)
Figure 2:
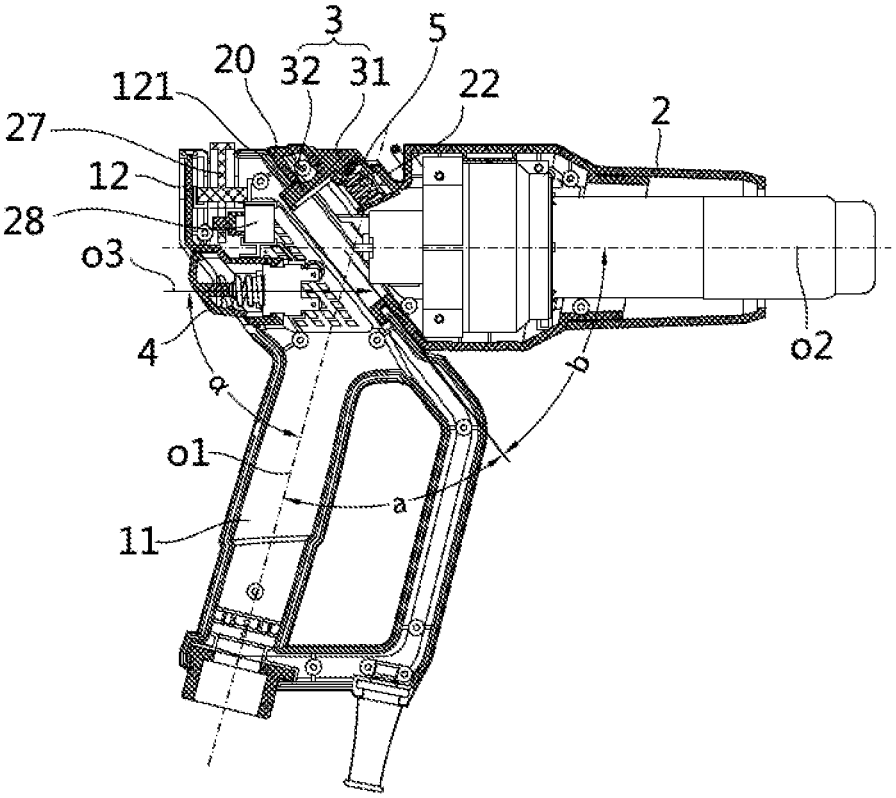
FIG. 2 is a longitudinal sectional view of the hot air heating gun in the preferred embodiment of the present utility model (conventional hot air operation)
Figure 7:
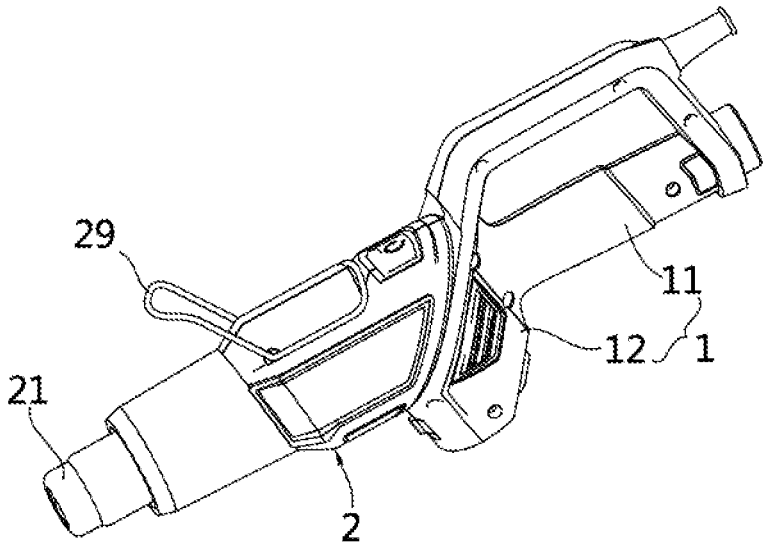
FIG. 7 is schematic diagram of the outer structure of the hot air heating gun in the preferred embodiment of the present utility model (charcoal burning machine)

Referring to the FIG. 1, FIG. 2, FIG. 7, the multifunction hot air heating gun of the preferred embodiment of the present utility model comprises a handle assembly and a gun head assembly 2. Said handle assembly comprises a handle 1 which is disposed with a first junction surface 121, and the first junction surface 121 comprises a rotating connect hole 15, while the gun head assembly 2 comprises a second junction surface 20 matching with the first junction surface, 121 and the second junction surface 20 is disposed with a rotating connect joint 25. The rotating connect joint 25 and the rotating connect hole 15 is connected so that the handle 1 and the gun head assembly 2 are connected together and may rotate relative to each other. More specifically, the gun head assembly 2 comprises a first position that is a used to eject hot air toward the extended direction of the handle axis and a second position that is used to eject hot air toward the lateral direction of the handle 1, and the gun head assembly 2 may pivot between the first position and the second position. As FIG. 1 shown, when the gun head pivots to the second position, the hot air heating gun may be used for general hot air operation, for example, for melting the plastic product to carry on welding process; as shown in FIG. 7, the hot air heating gun may be used as a charcoal-burning machine.

The gun head assembly 2 is disposed with parts such as heat source, fan, blades and so on in it to produce hot air. The hot air ejects from the jet 21 disposed at the front end of the gun head assembly 2. Specific structures and the principle may be learned referring to the hot air heating gun in the prior art, here will not be explained in details.

Figure 3:
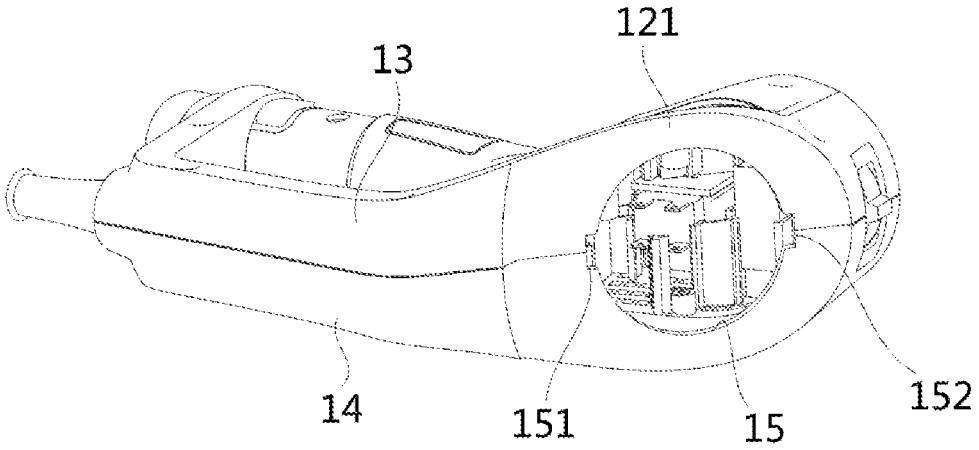
FIG. 3 is a schematic diagram of the handle of the hot air heating gun in the preferred embodiment of the present utility model.
Figure 4:
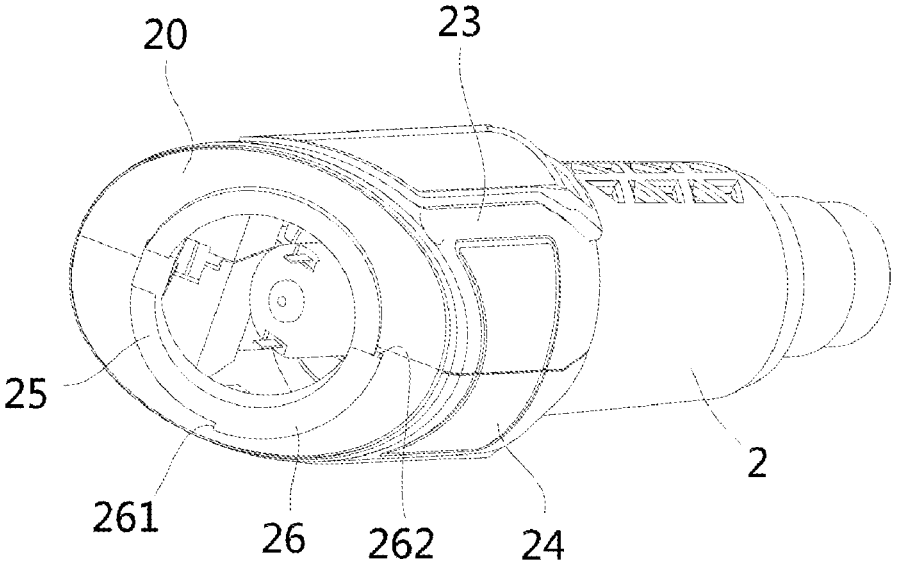
FIG. 4 is a schematic diagram of the head gun assembly of the hot air heating gun in the preferred embodiment of the present utility model.

Referring to the FIG. 3 and FIG. 4, the handle assembly and the gun head assembly 2 are both adopted with divided structures, that is: the handle assembly comprises a left handle housing 14 and a right handle housing 13, and the gun head assembly 2 comprises a left gun head housing 14 and a right gun head housing 13. Said rotating connect hole 15 is formed after the left handle housing 14 and the right handle housing 13 are assembled, and said rotating joint 25 is formed after the left gun head housing 24 and the right gun head housing 23 are assembled.

The handle of present embodiment comprises a gripping part 11 and a connecting part 12 that is disposed in the front end of the gripping part 11. The first junction surface 121 is located on the connecting part 12 and is disposed in a inclined way relative to the handle axis o1 with an angle a. As shown in FIG. 2, he second junction surface 20 contacts the first junction surface 121 and rotates relative to the first junction surface 121. That is, the second junction surface 20 is also disposed in a inclined way relative to the axis o2 of the gun head assembly with an angle b. It can be understood with referring to FIG. 7 that angle a and angle be are equal, therefore, the gun head assembly 2 may rotates relative to the handle 1 freely, and the operation is more comfortable.

The gun head assembly 2 of the present embodiment is disposed with a switching button 3 for convenience. Said switching button 3 comprises a locking position that is used for limit the relative rotation of the handle assembly and the gun head assembly 2 and an unlocking position that is used to release the limit. More specifically, the switching button 3 comprises a button body 31 and a positioning block 32 extended from the button body 31, and the gun head assembly 2 is disposed with a button groove 22 that is used to accept the button body 31. A reset spring 5 is disposed between the button groove 22 and the button body 31. The switching button body may move from the locking position to the unlocking position by pressing the button body 31, while the reset spring 5 drives the switching button 3 to move from the unlock position to the lock position by releasing the button body 31.

In order to cooperate the operation way of the switching button 3, a first positioning slot 151 and a second positioning slot 152 are disposed with intervals in the circumference direction of the rotating joint 15. As shown in FIG. 1, when the gun head assembly 2 is in the second position, the positioning block 32 is stuck in the second positioning slot 152 with the action of the spring 5, so as to keep the gun head assembly 2 in the second position. If the hot air heating gun is expected to use as a charcoal-burning machine, users may press the switching button 3 to release the positioning block 32 from the second positioning slot 152, and then turn the gun head assembly 2 to the state that FIG. 7 is shown, and when the switching button 3 is released, the positioning block 32 is stuck in the first positioning slot 151 to keep the gun head assembly 2 in the first position, in this way, switching and locking of the gun head assembly 2 between the first position and the second position, that is, switching and locking of regular hot air operation and the charcoal-burning function is realized. During the rotation, as the inner wall of the rotating joint 15 contacts the switching button 3, users may release the switching button 3. When the gun head assembly 2 rotates to the first position or to the second position, the positioning block 32 may be stuck into the first positioning slot 151 and the second positioning slot 152 automatically to realize locking operation.

Figure 5:
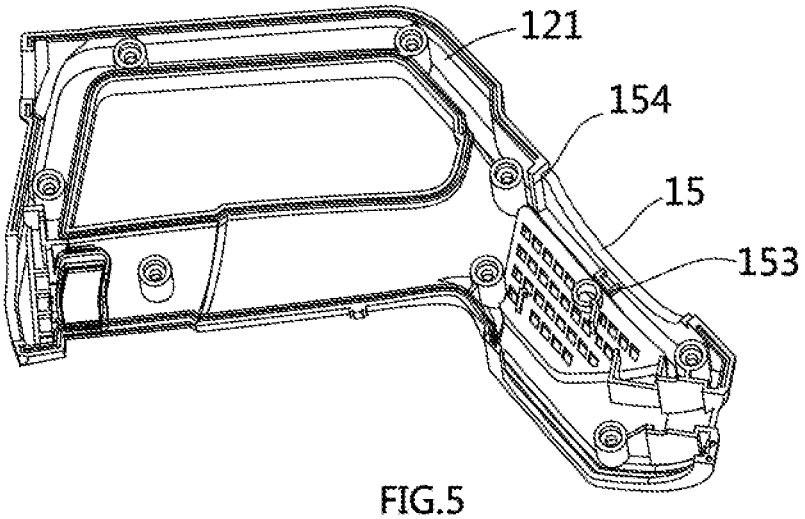
FIG. 5 is a schematic diagram of the inner structure of the left housing of handle of the hot air heating gun in the preferred embodiment of the present utility model.

Referring to FIG. 5, more preferred, the first positioning slot 151 and the second positioning slot 152 are spaced with a interval of 180° along the circumstance direction, in other words, the rotating joint 25 may turn the gun head assembly 2 from the first position to the second position, or from the second position to the first position by making the rotating joint rotate 180° relative to the rotating connect hole 15. This structure is designed for satisfying the function design requirement better, and to improve the using effect. In order to prevent excessive rotational motion, the rotating joint 25 is disposed with a limit piece 26 projecting radially on the periphery. Two sides of the limit piece 26 in the circumference direction is defined as a first limit end 261 and a second limit end 262 respectively, and the a first limit block 153 and a second limit block 154 are disposed with intervals in the inner side of the rotating connecting hole 15 along the circumference direction. When the gun head assembly 2 pivots to the first position, the first limit end 261 contacts with the first limit block 153 to prevent the gun head assembly 2 from rotating, and when the gun head assembly 2 pivots to the second position, the second limit end 262 contacts with the second limit block 154 to prevent the gun head assembly 2 from rotating. If the first positioning slot 151 and the second positioning slot 152 are used in combination, the angle between the first limit end 261 and the second limit end 262 of the limit piece along the circumstance direction is 90°, and the angle between the first limit block 153 and the second limit block 154 along the circumstance direction is 90° too, therefore, the gun head assembly 2 could only move back and forth between the first position and the second position, thus ensuring the reliability.

With the abovementioned structures and principle, those skilled in the art can easily understand that the switching button may also be disposed at the handle assembly, and the detailed solution is just like the abovementioned embodiment, here will not be described in details.

The handle 1 of the present embodiment is disposed with an on-and-off button 4, which is disposed on the connecting part 12 at the side with its back to the gun head assembly 2. Referring to FIG. 2, the position where the on-and-off button 4 is located is close to the gripping part 11 of the handle 1. Therefore, when the hot air heating gun is used for regular hot air operation or used as a charcoal-burning machine, users may operate with a single hand, which is more convenient. More preferably is, the drive direction o3 of the on-and-off button 4 and the handle axis o1 form a angle $\alpha$, and $0° < \alpha < 90°$, with this angle, the users can easily apply force to the on-and-off button 4 and press the button when they are gripping the handle 1. This design is conformity to custom and improves comfort. More preferably is, $\alpha$ is 5°, 25°, 40°, 60°, 80° and so on.

Figure 6:
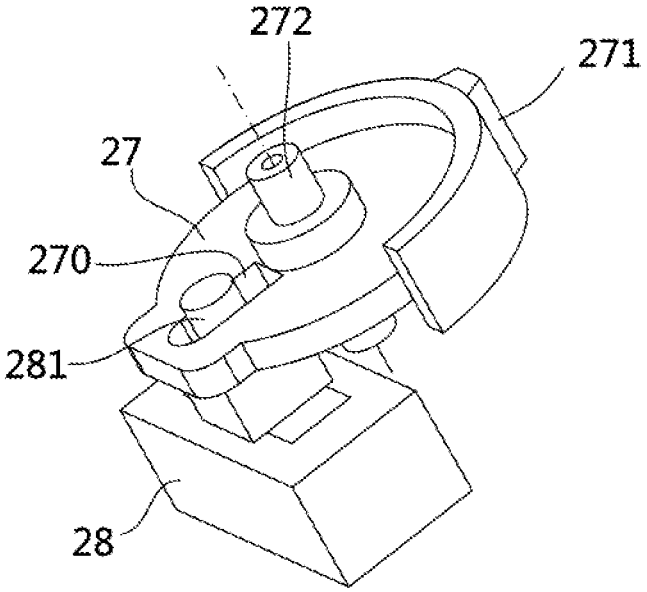
FIG. 6 is a schematic diagram of the connection structure of the hot air speed shift switch and the rotating disk in the preferred embodiment of the present utility model.

In addition, different functions of the hot air heating gun correspond to different hot air temperatures, for example, the temperature required for melting solders is 425-455° C., while temperatures are required to reach 550° or even higher when the hot air heating gun is used for burning charcoal. For these reasons, in the present embodiment, the handle is disposed with a speed shift switch 28 and a rotating disk 27. The speed shift switch 28 is fixed in the handle, and the rotating disk 27 is rotationally connected onto the handle. The rotating disk 27 is turned to drive the speed shift switch 28 to regulate the intensity of the hot air. More specifically, Referring to FIG. 6, the rotating disk 27 is disposed with a slide slot 270, and the speed shift switch 28 is disposed with an adjustable arm 281. The adjustable arm 281 is inserted into the slide slot 270 and may slides along the slide slot 270. The rotating disk 27 is disposed with a driven block 271, which is exposed at the outer part of the handle. Users turn the driven block 271 to drive the rotating disk 27 rotate, and then the rotating disk 27 rotates and drives the adjustable arm 281 to slide to realize adjustment of different speed. The detailed structures and the principle of the speed shift switch will not be described here in details.

Referring to FIG. 7, the gun head assembly 2 in the present embodiment is disposed with a support frame 29, which comprises a support position and a folded position, and the support frame 29 may move between the support position and the folded position. When the hot air heating gun is used as a charcoal-burning machine, users may move the support frame 29 to the support position (as FIG. 7 shown), and then the hot air heating gun may be positioned on the ground stably by the support frame. More specifically, the support frame 29 is an U-shaped metal support, which has a strong strength, and two ends of the support frame 29 is rotationally connected at the gun head assembly 2, and the support frame 29 may turn from the support position to the folded position, or from the folded position to the support position. In other embodiments, the support frame 29 may still use the U-shaped metal support, but it will be installed at the gun head assembly by sliding mode, just like the bracing structure of the suitcase, where the support frame 29 may be folded from the support position to the folded position, or from the folded position to the support position.

Referring to FIG. 8-11, the handle assembly of the hot air heating gun in the present embodiment further comprises an extension rod 6 that is connected to the handle 1. The extension rod 6 is designed to facilitate the long distance operation of the user, for example, the weeding operation. In order to facilitate use, the tail part of the handle 1 is disposed with a plughole 111, and the extension rod 6 is sheathed with a connect head 61 at the front end, and at the end of the connect head 61 is disposed with an inserting block 611. The handle 1 is disposed with a flexible locking piece 9 and a unlock button 8. The flexible locking piece 9 has an U-shape, and at the two sidewalls of the flexible locking piece 9 is disposed with positioning bulges 91 projected inward respectively. The inserting block 611 is disposed with positioning slots 612 at two sides. The unlock button 8 is located above the opening 90 of the flexible locking piece 9. Two sidewalls of the flexible locking piece 9 will be driven to expand outward by pressing the unlocking button 8. The unlocking button 8 will bounce up and the two sidewalls of the flexible locking piece 9 collapse freely by releasing the button 8.

When the hot air heating gun is actually used, users may insert the inserting block 611 into the plughole 111 that is positioned at the tail part of the handle 1, and the positioning bulge 91 of the flexible locking piece 9 is truck into the positioning slot 612 to position the inserting block 611 to prevent the inserting block 611 escaping from the plughole 111, thus realize the connection of the extension rod 6 and the handle 1. When the hot air heating gun needs to be disassembled, users may press the unlocking button 8 to drive the positioning bulge 91 to escape from the positioning slot 612, at this moment, the extension rod 6 and the handle 1 may be separated by pulling the inserting block 611 outward. To improve the connecting reliability, a flexible pin may be disposed on the inserting block, and a stopper may be disposed in the inner wall of the plughole so that the flexible pin will abut on the stopper when the inserting block is inserted into the plughole, so as to further prevent the inserting block escaping from the plughole. When the hot air heating gun needs to be disassembled, the flexible blocking piece and the flexible pin can be driven at the same time by pressing the unlocking button to pull out the inserting block from the plughole. The detachable connection of the handle 1 and the extension rod 6 can be realized by the above solution, and the operation is convenient and efficient. The detachable connection of the handle and the extension rod can be realized through threaded connection in other embodiments of the present utility model.

The extension rod 6 of the present utility model uses a separated structure, to be more specific, uses multi connecting rods to form a detachable connection to adjust the length of the extension rod 6 according to different requirements to achieve better effects. More specifically, the extension rod 6 of the present utility model comprises a first connecting rod 62 and a second connecting rod 63. One end of the first connecting rod 62 is connected with the handle 1, and the other end of the first connection rod 62 is disposed with a plughole 622 and a fixing sleeve 621, and the second connection rod 63, at the end that closes to the fixing sleeve 621, is disposed with a plug 632 and a outer threaded sleeve 631. The first connected rod 62 is disposed with an inner threaded sleeve 64 moving along the axial direction. When the hot air heating gun is actually used, users may insert the plug 632 of the second connection rod 63 into the plughole 622 of the first connecting rod 62 to realize the preposition of the first connection rod 62 and the second connection rod 63, and then, screw the inner threaded sleeve 64 to mesh the outer threaded sleeve 631 of the second connection rod 63. Therefore, the coordination of fixing sleeve 621, the outer threaded sleeve 631 and the inner threaded sleeve 64 may prevent the first connection rod 62 and the second connection rod 63 separating, and when disassembly is needed, users only need to loose the inner threaded sleeve 64 and pull out the plug 632. It can be seen that the operation is very convenient.

Figure 8:
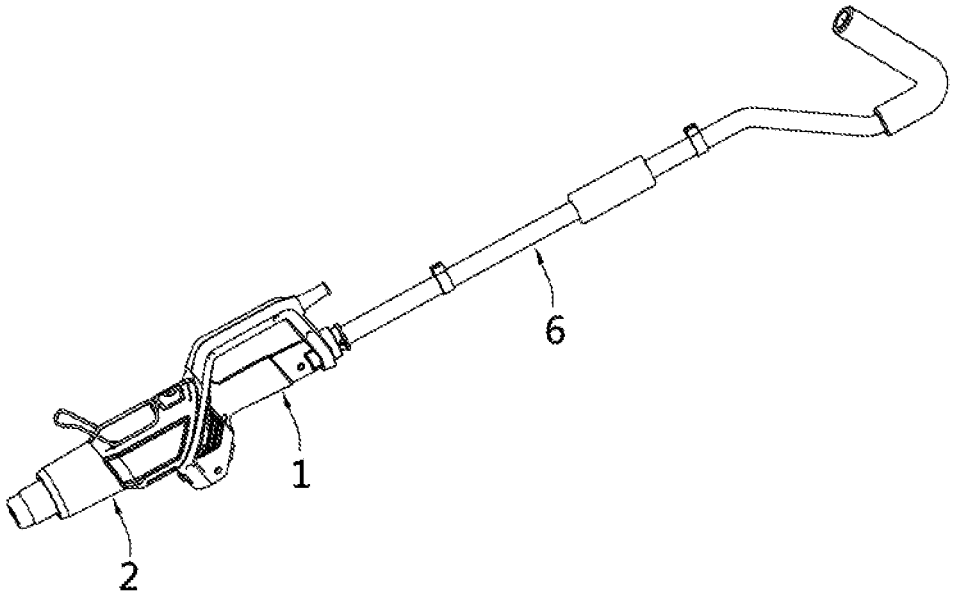
FIG. 8 is a schematic diagram of the outer structure of the hot air heating gun in the preferred embodiment of the present utility model (weeding machine)
Figure 9:
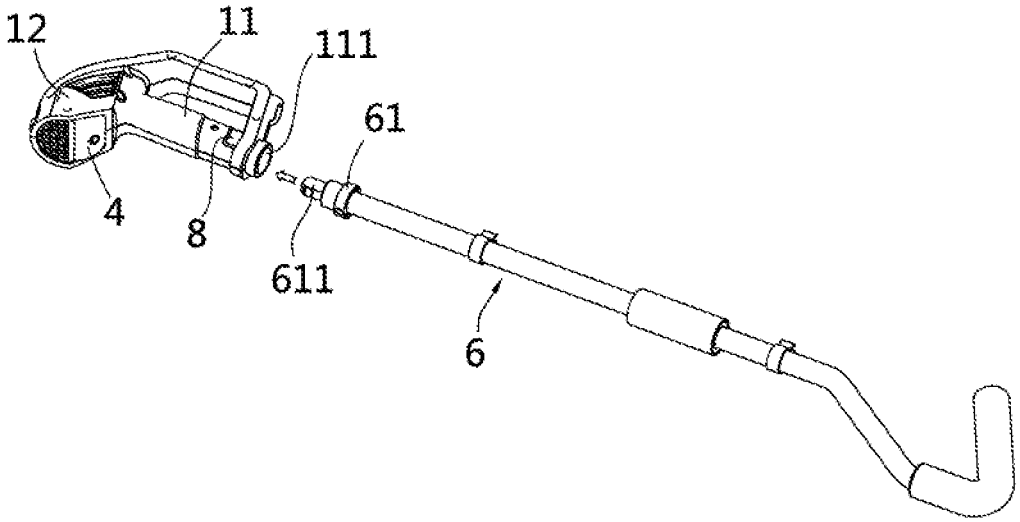
FIG. 9 is an assembly schematic diagram of the handle of the hot air heating gun and the extension rod.
Figure 10:
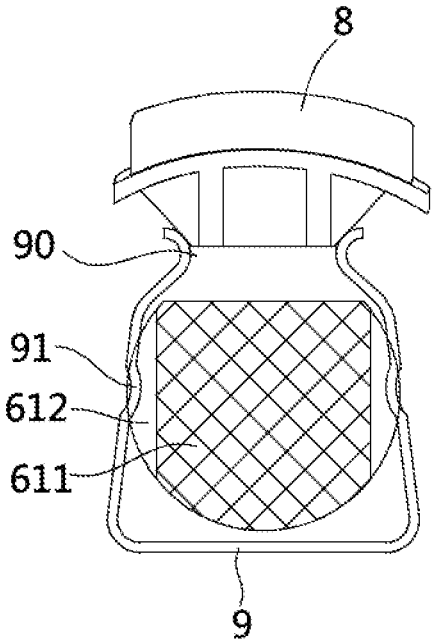
FIG. 10 is a sectional view of connection area of the handle of the hot air heating gun and the extension rod in the preferred embodiment of the present utility model (under the connecting situation)
Figure 11:
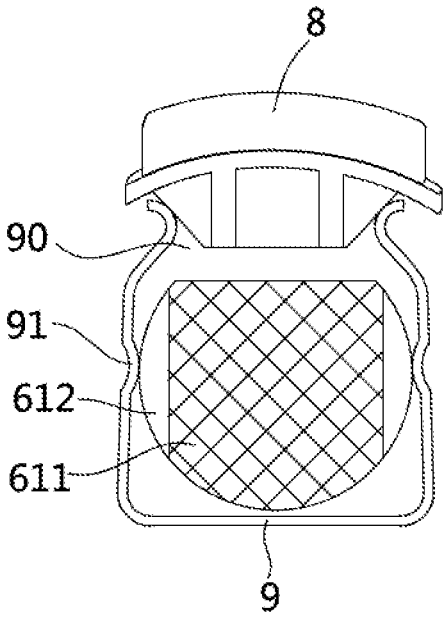
FIG. 11 is a sectional view of connection area of the handle of the hot air heating gun and the extension rod in the preferred embodiment of the present utility model (under the detaching situation)
Figure 12:
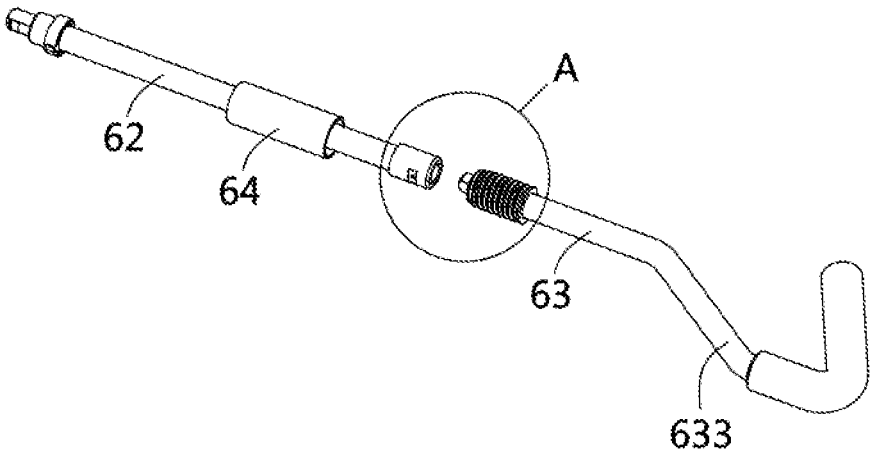
FIG. 12 is an exploded schematic diagram of the extension rod of the hot air heating gun in the preferred embodiment of the present utility model.
Figure 13:
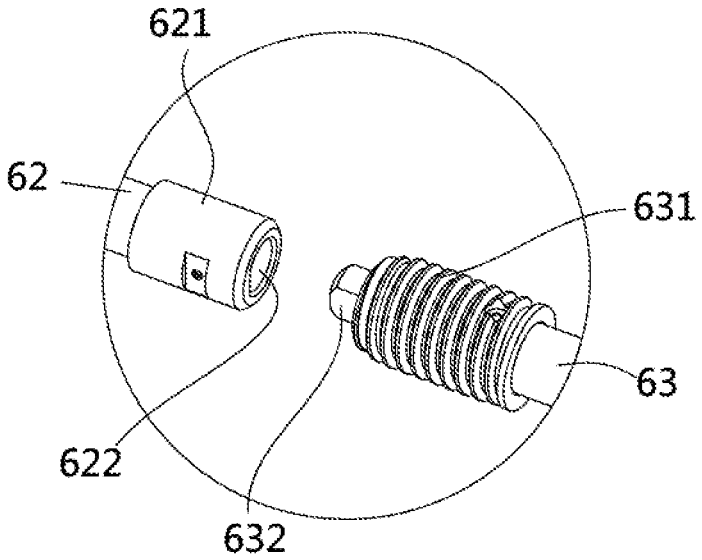
FIG. 13 is a partial enlarged detail of the position in the FIG. 12.

The other end of the second connection rod 63 may disposed with a grip holder 633 for ease of weeding operation. Referring to FIG. 8, when the hot air heating gun of the present utility model is used as a weeding machine, users may stand the hot air heating gun upright, and grip the grip holder 633 in the extension rod 6, and pressing the on-and-off button 4 on the handle 1 with one foot to realize weeding operation. The drive direction of the on-and-off button and the handle axis form an $\alpha$ angle, and $0° < \alpha < 90°$, with this angle, the users may easily press the on-and-off button 4 with their feet rather than leaning down and operating with their hands, even if the hot air heating gun is used as a weeding machine. Comparing with the hot air heating gun in the prior art, the hot air heating gun of the present embodiment is better in operability, and is flexible and convenience to use, and may switch between multifunction, thus achieves the function of multipurpose.

Combining with the above-mentioned structures and the principles, a person having ordinary skill in the art may easily understand that the extension rod may use more than two sections, for example, three sections, four sections, to achieve the purpose of adjusting lengths in a wider range, and the detachable connection structures between adjacent connection rods may refer to the above solutions.

The present embodiment of the utility model is used for hot air heating gun.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the utility model.

The invention claimed is:

1. A multifunction hot air heating gun, comprising:

a handle assembly, which comprises a handle and an extension rod that is connected to the handle, and a first junction surface disposed with a rotating connect hole is located on the handle;

a gun head assembly having a housing that is used for ejecting hot air, which comprises a second junction surface matching with the first junction surface, and the second junction surface is disposed with a rotating joint; the rotating joint and the rotating connect hole are connected together so as to make the handle and the gun head assembly be connected together and be able to rotate relative to each other; the gun head assembly rotates between a first position and a second position; the first position is used to eject hot air toward a first direction parallel to a longitudinal axis of the handle, while the second position is used to eject hot air toward a second direction which is shifted from the first direction; the gun head assembly is rotated between the first position and the second position;

a switching button, which is disposed on the handle assembly or the gun head assembly and comprises a locking position and an unlocking position; the locking position is used for limit the relative rotate of the handle assembly and the gun head assembly, and the unlocking position is used to release the limit;

an on-and-off button, which is disposed on the handle assembly to control the operation of the gun head assembly.

2. The multifunction hot air heating gun according to claim 1, wherein the rotating joint rotates 180° relative to the rotating connector hole so as to turn the gun head assembly from the first position to the second position, or from the second position to the first position.

3. The multifunction hot air heating gun according to claim 1, wherein the handle comprises a gripping part and a connecting part that is disposed in a front end of the gripping part; the first junction surface is located on the connecting part and is disposed in an inclined way relative to the longitudinal axis of the handle; the second junction surface contacts the first junction surface and rotates relative to the first junction surface.

4. The multifunction hot air heating gun according to claim 3, wherein the on-and-off button is disposed on the connecting part at a hack side corresponding to the gun head assembly.

5. The multifunction hot air heating gun according to claim 4, wherein a drive direction of the on-and-off button and the longitudinal axis of the handle form an angle ($\alpha$), and $0° < \alpha < 90°$.

6. The multifunction hot air heating gun according to claim 1, wherein a first positioning slot and a second positioning slot are disposed with an interval in a circumference direction of the rotating joint, and the switching button is disposed with a positioning block; when the gun head assembly rotates to the first position, the positioning block is plugged into the first positioning slot to keep the gun head assembly in the first position, and when the gun head assembly rotates to the second position, the positioning block is plugged into the second slot to keep the gun head assembly in the second position.

7. The multifunction hot air heating gun according to claim 1, wherein the rotating joint is disposed with a limit piece projecting radially on the periphery; two sides of the limit piece in the circumference direction is defined as a first limit end and a second limit end respectively, and a first limit block and a second limit block are disposed with intervals in an inner side of the rotating connecting hole along the circumference direction; when the gun head assembly rotates to the first position, the first limit end contacts with the first limit block to prevent the gun head assembly from going on to rotate, and when the gun head assembly rotates to the second position, the second limit end contacts with the second limit block to prevent the gun head assembly from going on to rotate.

8. The multifunction hot air heating gun according to claim 1, wherein the handle and the extension rod form a detachable connection.

9. The multifunction hot air heating gun according to claim 1, wherein the handle is disposed with a speed shift switch and a rotating disk; the speed shift switch is fitted in the handle, and the rotating disk is rotationally connected onto the handle.

10. The multifunction hot air heating gun according to claim 1, wherein the gun head assembly is disposed with a support frame, which comprises a support position and a folded position, and the support frame may move between the support position and the folded position.

* * * * *